US006529162B2

(12) United States Patent
Newberg et al.

(10) Patent No.: US 6,529,162 B2
(45) Date of Patent: Mar. 4, 2003

(54) PHASED ARRAY ANTENNA SYSTEM WITH VIRTUAL TIME DELAY BEAM STEERING

(76) Inventors: Irwin L. Newberg, 702 Palisades Dr., Pacific Palisades, CA (US) 90272; Oleg Brovko, 3638 Mountain View Ave., Los Angeles, CA (US) 90066; Steve I. Hsu, 10 Clipper Rd., Rancho Palos Verdes, CA (US) 90275; Robert A. Kosmala, 8163 Redlands St. #13, Playa Del Rey, CA (US) 90193; Trung T. Nguyen, 21222 Spurney La., Huntington Beach, CA (US) 92646; Ricardo Rico, Jr., 9369 Farm St., Downey, CA (US) 90241

( * ) Notice: Subject to any disclaimer, the term of this patent is extended or adjusted under 35 U.S.C. 154(b) by 0 days.

(21) Appl. No.: 09/859,927

(22) Filed: May 17, 2001

(65) Prior Publication Data

US 2002/0175859 A1 Nov. 28, 2002

(51) Int. Cl.[7] ..... H01Q 3/22
(52) U.S. Cl. ..... 342/375; 342/372; 342/373
(58) Field of Search ..... 342/375, 368, 342/373, 372

(56) References Cited

U.S. PATENT DOCUMENTS 3,600,701 A * 8/1971 Gouldthorpe ..... 331/45
3,618,097 A * 11/1971 McLeod ..... 343/100 SA
4,263,600 A 4/1981 Williams et al.
4,749,995 A * 6/1988 Hopwood et al. ..... 342/371
5,111,208 A * 5/1992 Lopez ..... 342/174
5,351,053 A * 9/1994 Wicks et al. ..... 342/158
5,523,764 A * 6/1996 Martinez et al. ..... 342/372
5,543,805 A * 8/1996 Thaniyavarn ..... 342/368
5,592,178 A * 1/1997 Chang et al. ..... 342/372
5,771,016 A * 6/1998 Mullins et al. ..... 342/372

* cited by examiner

*Primary Examiner*—Dao Phan
(74) *Attorney, Agent, or Firm*—Leonard A. Alkov; Glenn H. Lenzen, Jr.

(57) ABSTRACT

A system and technique for phased array antenna beam steering for transmitting and receiving without sending the waveform through an actual (physical) time delay when a time varying frequency is used as the waveform. The inventive system is adapted for use with an antenna having an array of radiating elements and includes a plurality of signal sources. Each source is adapted to provide a signal having a predetermined frequency offset signal for an associated radiating element or set of radiating elements. For transmit a plurality of first mixers is provided. Each of the first mixers is coupled to receive an excitation signal as a first input and the output from a respective one of the sources as a second input. The output of each mixer is coupled to a respective subset of the antenna radiating elements. In effect, each of the sources provides a virtual time delay. In a specific embodiment, the virtual time delay source includes a direct digital synthesizer and a digital-to-analog converter connected to receive the output thereof. A second mixer is included in each source for mixing the output of the converter with the output of a supplemental signal source. For receive the process is implemented the same way as for transmit for the range of the desired "target" return. The output of the second mixer is supplied to a respective one of the first mixers. The invention adjusts the phase and frequency of an RF waveform that is spread out in frequency and time such that each frequency arrives at the radiating elements of a phased array antenna with the phase that will steer the antenna beam in the desired direction. The relative signal phase at each radiating element is made to be independent of the signal carrier frequency and thus the antenna beam pointing is made independent of RF carrier frequency.

5 Claims, 7 Drawing Sheets

PHASED ARRAY ANTENNA SYSTEM WITH VIRTUAL TIME DELAY BEAM STEERING

BACKGROUND OF THE INVENTION

1. Field of the Invention

The present invention relates to antennas. More specifically, the present invention relates to systems and methods for effecting delay in large phased array antennas.

2. Description of the Related Art

Phased array antennas are well known in the art. Phased array antennas are implemented with a large number of radiating elements, which are individually excited. Beam steering is effected by delaying the excitation of selected radiating elements. For most applications, smaller antennas are used. For these antennas, adequate delays can be supplied by adjusting the phase of the excitation signals supplied to the radiating elements, hence the term 'Phased Array Antennas' is used.

However, for spacecraft and other applications, large phased array antennas are required to obtain higher gain at longer detection ranges. In addition, various pulse compression techniques are typically used to achieve higher average radiated power for longer detection range while having range resolution for target discrimination or mapping resolution. Pulse compression results in signals with wider bandwidths. When the size of the phase array antenna becomes relatively large and wide bandwidth waveforms for high range resolution are needed, some form of true time delay (TTD) antenna beam steering, as opposed to phase only beam steering is needed to accommodate the size, bandwidth and scan angle requirements of the antenna.

Conventionally, TTD beam steering has been achieved by using delay lines to feed the radiating elements. Coax, waveguide and fiber optic cables have been used to provide the necessary TTD. However, coaxial delay elements are heavy and induce dispersion in the output beam. Dispersion is to due a failure to transmit each frequency component at a uniform speed and leads to a corruption of the wavefront.

The use of waveguides and fiber optic cables could be found to be expensive and impractical (e.g., too heavy) for space and other applications.

When the RF signal has a wide instantaneous bandwidth, then typically physical delays are needed to point an antenna array. For the case where wide bandwidth is obtained using a time varying frequency waveform, then techniques that do not use physical delays in the signal path can be utilized.

Hence, a need remains in the art for a system and method for delaying excitation of radiating elements in large antennas with respect to wide bandwidth time varying frequency signals and wide scan angles without using physical delay elements.

SUMMARY OF THE INVENTION

The need in the art is addressed by the beam steering system and method of the present invention. The inventive system is adapted for use with an antenna having an array of radiating elements and includes a plurality of signal sources. Each source is adapted to provide a signal having a predetermined frequency offset signal for an associated radiating element or set of radiating elements. A plurality of first mixers is provided. Each of the first mixers is coupled to receive an excitation signal as a first input and the output from a respective one of the sources as a second input. The output of each mixer is coupled to a respective subset of the antenna radiating elements.

In effect, each of the sources provides a virtual time delay. In a specific embodiment, the virtual time delay source includes a direct digital synthesizer that has a digital-to-analog (D/A) converter included in said synthesizer to receive the output thereof. A second mixer is included in each source for mixing the output of the converter with the output of a supplemental signal source. The output of the second mixer is supplied to a respective one of the first mixers.

The invention provides a technique for generation of a virtual time delay (VTD) for phased array antenna beam steering without sending the waveform through an actual (physical) time delay. The technique adjusts the phase and frequency of an RF waveform that is spread out in frequency and time such that each frequency arrives at the radiating elements of a phased array antenna with the phase that will steer the antenna beam in the desired direction. The relative signal phase at each radiating element is made to be independent of the signal carrier frequency and thus the antenna beam pointing is made independent of RF carrier frequency.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present teachings are made clear with reference to conventional teachings for effecting beam steering in phase array antennas. Beam steering in phase is typically effected with phased array antennas by adjusting the phase of the signals applied to or received from the radiating elements. For relatively large antennas, beam steering must be effected through the use of physical or 'true' time delay elements.

Figure 1:
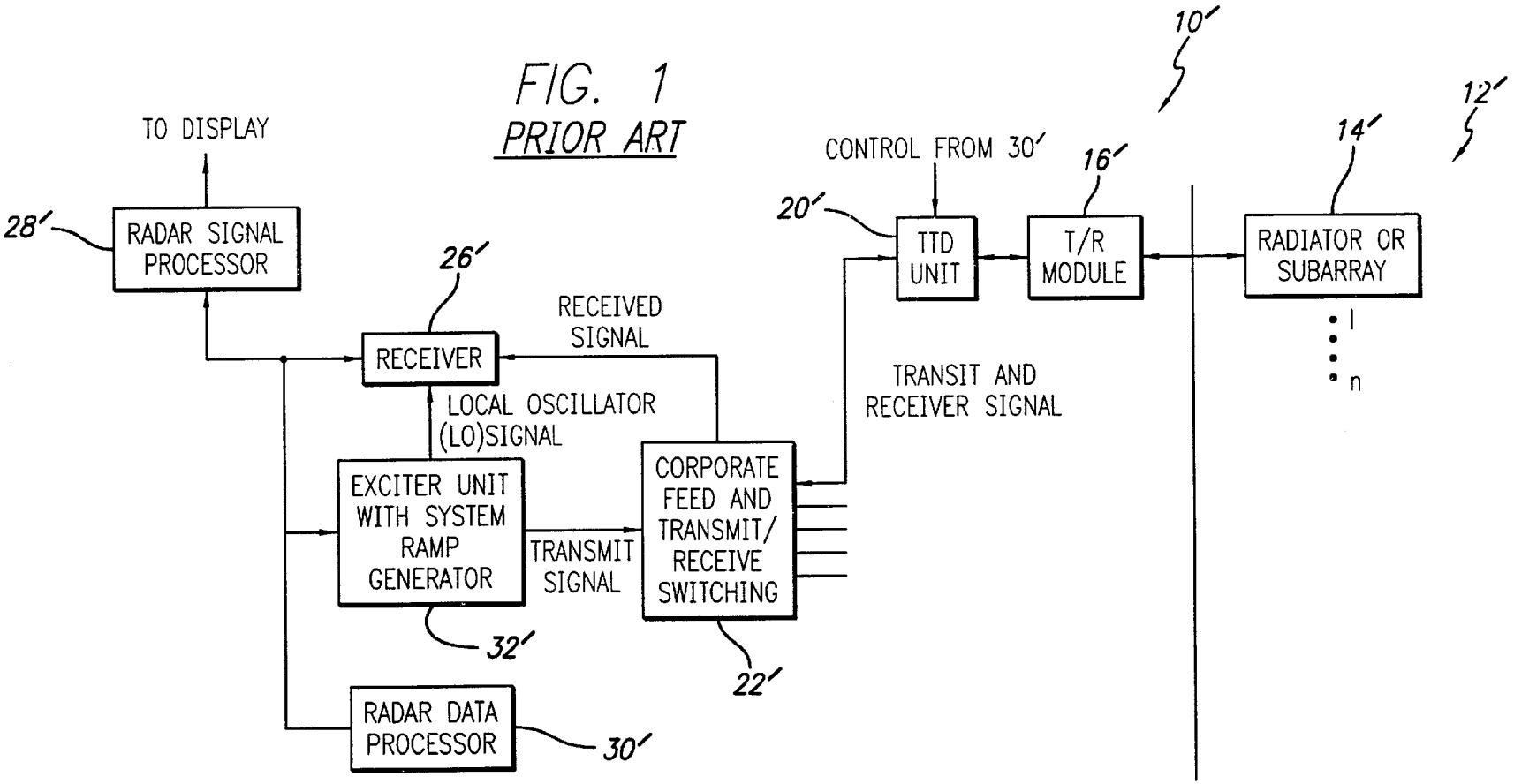
FIG. 1 PRIOR ART
FIG. 1 is a simplified block diagram of a radar system with phased array antenna with beam steering effected with true time delay in accordance with conventional teachings.

FIG. 1 is a simplified block diagram of a radar system with phased array antenna with beam steering effected with true time delay in accordance with conventional teachings. The system 10' includes an antenna 12' with an array of radiating elements 14'. Each element 14' is fed by a transmit/receive module 16', which includes post and preamplifiers, attenuators and phase shifters. Each T/R module 16' is driven by a true time delay circuit 20'. The true time delay (TTD) circuit 20' is discussed more fully below with reference to FIG. 2. Each TTD circuit 20' is fed by a respective output of a corporate feed circuit 22' which is an RF manifold for RF signals going to and from each T/R module.

In a receive mode, signals received through the corporate feed 22' are input to a receiver 26'. The output of the receiver 26' is provided to a radar signal processor 28'. The radar signal processor then outputs to a display. The radar data processor 30' controls radar functions, one of which effects beam steering by selectively activating appropriate radiating elements through associated TTD units as is common in the art.

In a transmit mode, an exciter with a basic ramp generator 32' supplies an excitation signal to the corporate feed 22'. The signal from the corporate feed is fed to selected radiating elements 14' through associated TTD units 20' and T/R modules 16'.

Figure 2:
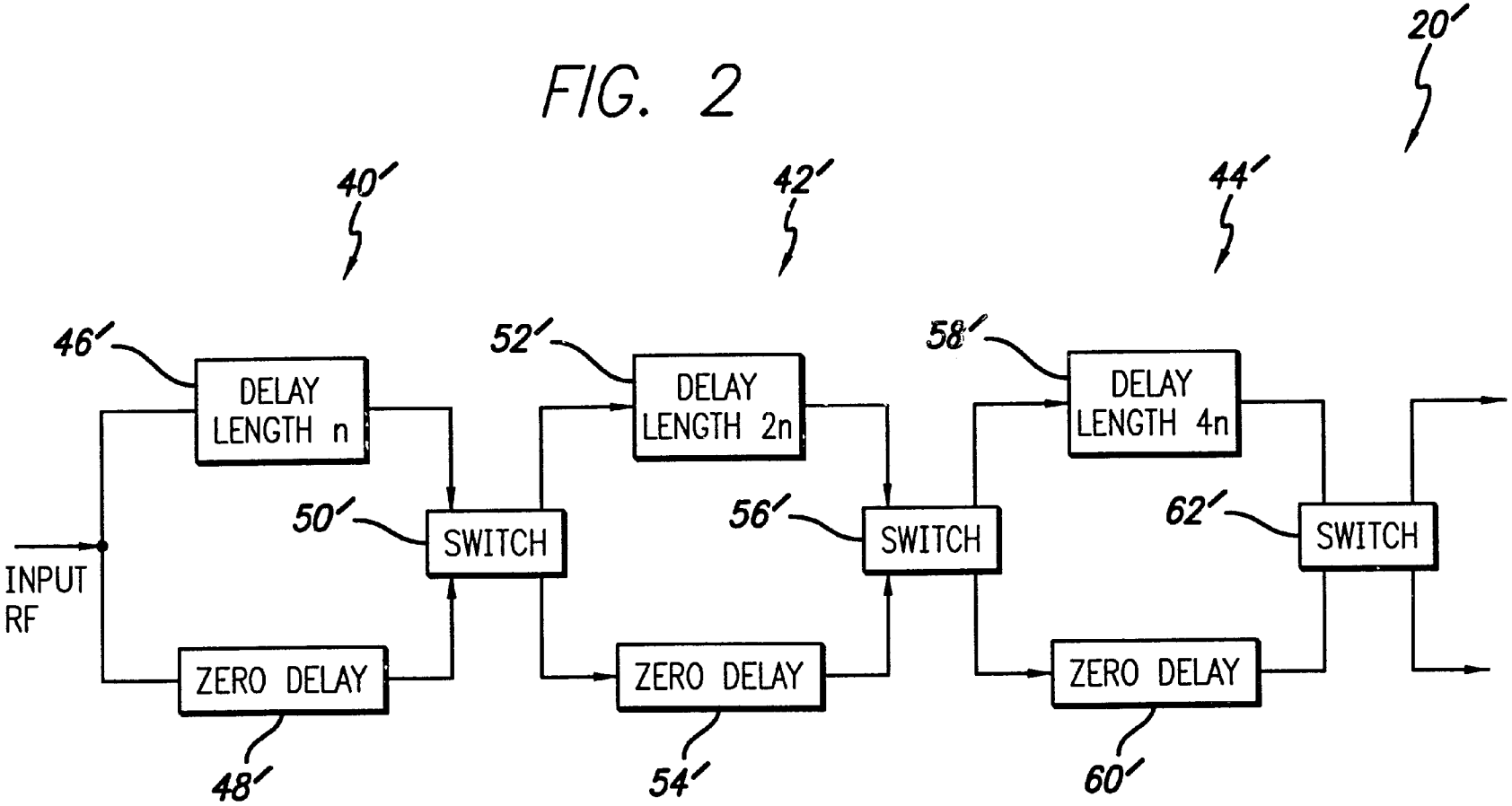
FIG. 2 is a simplified block diagram of a portion of a binary true time delay circuit that can be utilized in the radar system of FIG. 1.

FIG. 2 is a simplified block diagram of a portion of the true time delay circuit, 20', utilized in the radar system of FIG. 1. The TTDs 20' each include plural sets of delay stages of which only three are shown 40', 42', and 44'. In practice, the number of sets of delay stages would be determined based on the amount of delay and resulting beam steering required for a given application. Each delay stage 40', 42', and 44' includes a physical delay element 46', 52' and 58', respectively, and a zero delay element (typically a simple line) 48', 54', and 60', respectively. Each stage 40', 42', and 44' includes a switch 50', 56' and 62', respectively, which selects the output of the physical delay element or the zero delay element depending the amount of delay required. The switches are controlled by the data processor 30' of FIG. 1 through control lines (not shown). While the switch controls are not shown, it is understood, that the use of switches is only required to the extent that it is desired to change the delay afforded by a given TTD circuit 20'. In a fixed beam direction application, the switches may be eliminated.

Figure 3:
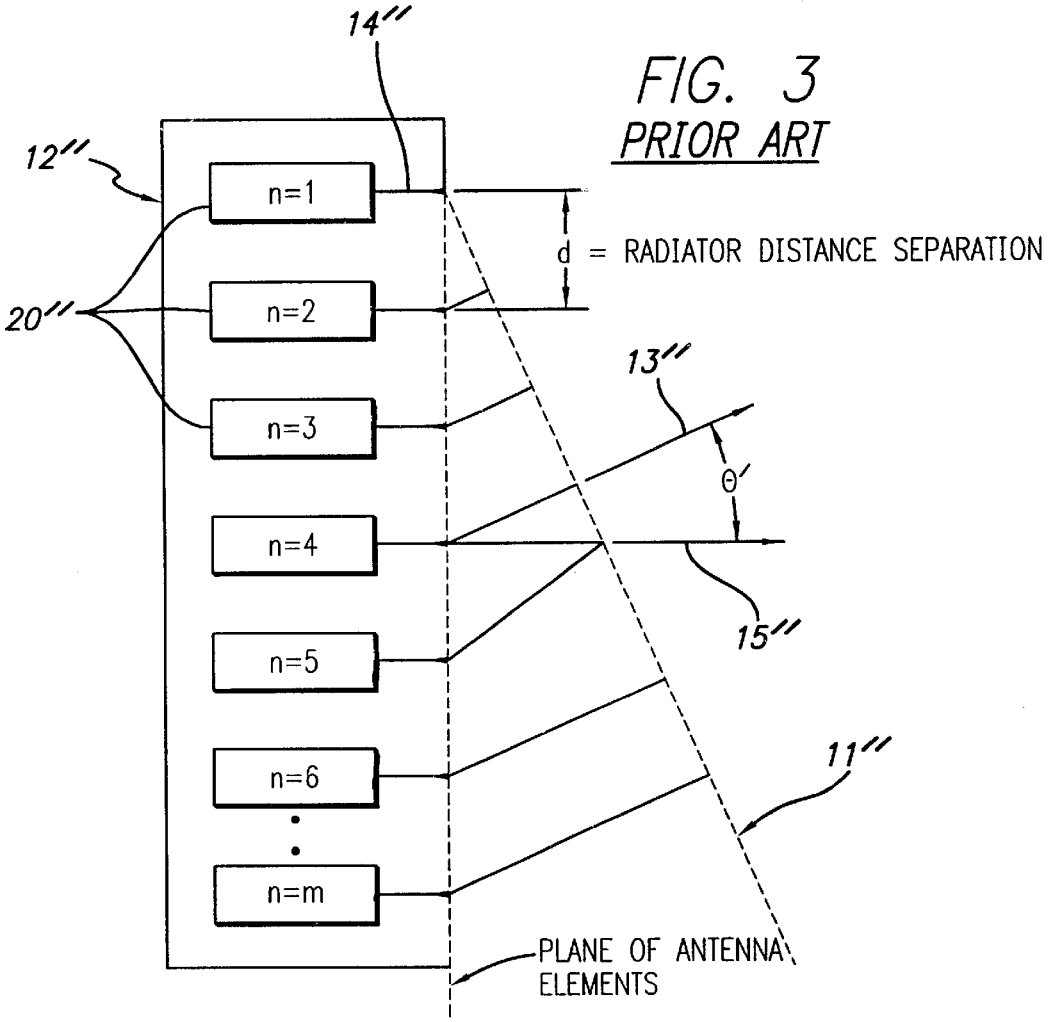
FIG. 3 PRIOR ART
FIG. 3 is a simplified block diagram showing a typical conventional phased array antenna and illustrating conventional phase steering.

To illustrate the principles of electronic beam steering, reference is made to the phased array antenna of FIG. 3.

FIG. 3 is a simplified block diagram showing a typical conventional phased array antenna and illustrating conventional phase steering as opposed to TTD steering. The phased array antenna 12" includes plural individual radiating elements 14", each of which is fed by a respective phase shifter 20". The relative phases of the signals radiated or received by the antenna elements control the effective beam pointing direction. The equation for calculation of the phase shift in terms of the pointing angle, element separation, and carrier frequency (wavelength) is:

$$\varnothing_n=(2\pi d \sin \theta)(n-1)/\lambda \qquad [1]$$

where $\lambda$ is the wavelength of the excitation signal and is equal to c/f, $\varnothing_n$ is the phase shift for element n, n is an integer that varies from 1 to m, m is the number of radiating elements, c is the velocity of the radio frequency signal in air and f is the frequency of the excitation signal. Each phase shifter provides signals to and receives signals from its corresponding antenna element. A pointing angle is established by imparting an appropriate phase shift to the transmit and receive signals at each phase shifter. The RF (radio frequency) wavefront 11" represents a line along which signals transmitted from or received at each of the antenna elements will line up in phase. The beam pointing direction 13" is perpendicular to the RF wavefront. The beam pointing direction and RF wavefront define a beam pointing angle $\theta$ relative to the plane of the antenna elements, i.e., the array broadside or boresight 15". An effective beam-pointing angle is established for transmit and receive signals by applying an appropriate phase shift to the signals as they are transmitted or received by elements in the array. This is further illustrated with respect to FIG. 4.

Figure 4:
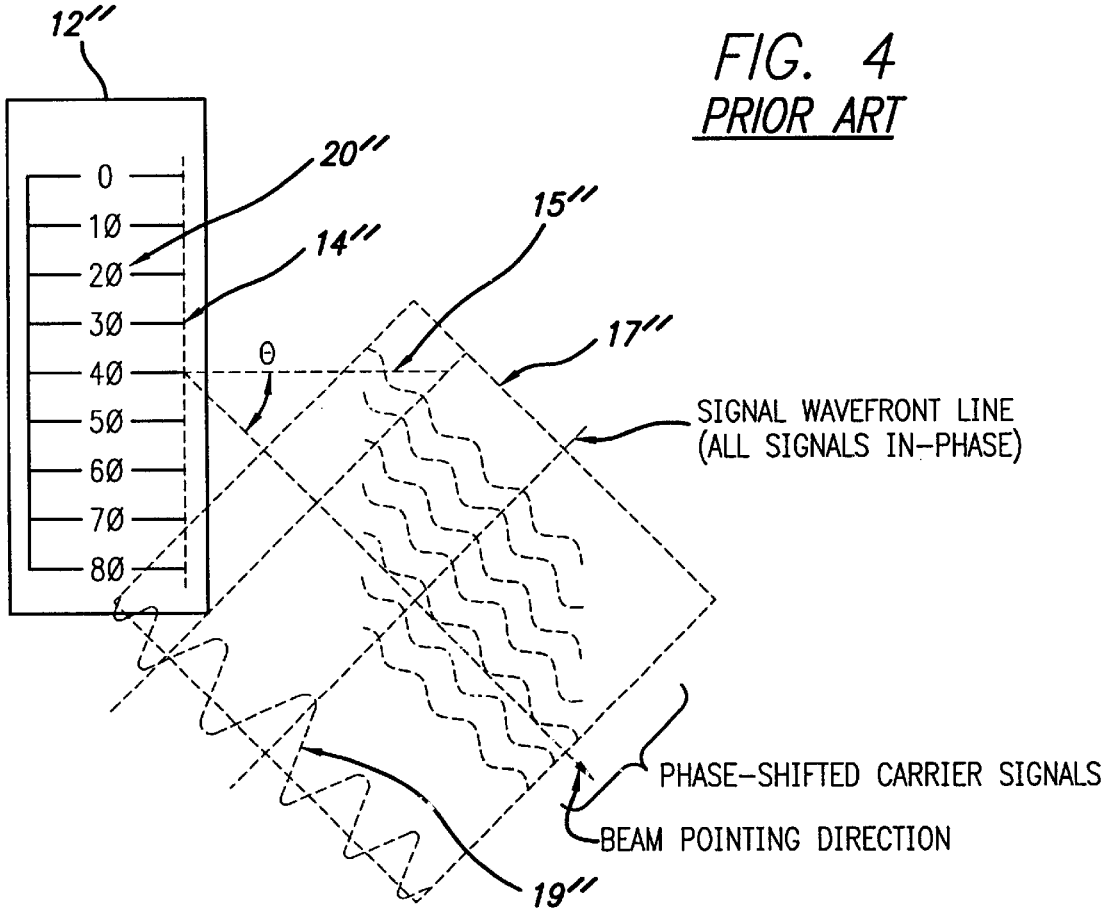
FIG. 4 PRIOR ART
FIG. 4 is a diagram illustrating operation of a phased array antenna utilizing conventional phase shifters.

FIG. 4 is a diagram illustrating operation of a phased array antenna utilizing conventional phase shifters. As mentioned above, the antenna system 12" includes a number of phase shifters which impart an appropriate phase shift (Ø) to the signals transmitted by or received from their corresponding antenna radiator elements. The different phase shift applied by each phase shifter provides a beam pointing direction at a desired beam-pointing angle.

FIG. 4 also shows a portion of a radar signal in a radar pulse. The radar signal includes a pulse modulation envelope 17" superimposed on a composite RF carrier signal 19". The different phase shift imparted to signals from each phase shifter results in a number of distinct phase shifted carrier signals. For purposes of clarity, only the portion of each carrier signal which falls within the time duration of a single modulation pulse is shown and the delta delay of the signals from each radiator is made relatively larger to show the effect. The various phase shifted versions of the carrier signals combine to produce the composite RF signal. The line that is perpendicular to the beam pointing direction defines the RF wavefront. Along the wavefront all of the various phase-shifted versions of the RF carrier signal are aligned in phase and combine to produce the peak of the signal. However, since each phase shifted signal takes a different amount of time to arrive at the wavefront line, the composite carrier signal is spread out in time and the carrier signal energy is not concentrated within the time duration of the pulse as desired. The pulse modulation envelope therefore has a greater time duration that the original pulse itself.

Present phase shifting techniques are capable of precisely establishing a particular beam pointing direction only over a relatively limited RF carrier signal frequency range. The appropriate phase shift applied in each phase shifter is a function of RF carrier frequency as well as desired beam pointing angle. (See equation [1].) Frequency components of the radar pulsed signal which are higher or lower than the carrier frequency are therefore also shifted in phase by the same fixed phase shift and do not arrive at the wavefront at the same time so that the pulse length is centered about the in phase line. This is typically not a problem in most relatively narrow bandwidth radar frequency operations.

When the frequency dependency of the phase shift tends to limit the instantaneous bandwidth over which phased array radars can effectively operate, phase shifter steering alone will degrade the radar antenna performance. The instantaneous bandwidth is usually defined as the frequency range occupied by a particular signal at a given instant in time. For example, a narrow pulse of 1 nanosecond has an instantaneous bandwidth of 1 GHz. Instantaneous bandwidth should be distinguished from tuning bandwidth, which is typically defined as the total frequency range over which a system can be tuned or operated. The instantaneous bandwidth in a phased array antenna system using conventional phase shifters is limited because a fixed phase shift at a particular carrier frequency and beam pointing angle results in an excessive total phase shift at higher frequencies and an insufficient total phase shift at lower frequencies. A phase shifter has constant phase over some limited frequency range; this is distinguished from a delay in a length of cable that has a phase that varies linearly over frequency. The greater the deviation in frequency from the carrier frequency, in combination with the antenna length and pointing angle off broadside, the greater the deviation from desired beam pointing direction. The transmitted and received signals are spread in angle, depending on the frequency separation from the carrier center frequency, and thereby distorted by the deviation in beam pointing direction, termed beam spread or skew. Currently available phase shifting techniques therefore limit the instantaneous bandwidth over which phased array radars can operate.

True time delay beam steering is used to alleviate the limited instantaneous bandwidth problem in phased array antenna that cause beam spread associated with conventional phase shifters and phase shifter steered array. Delaying the arrival of the radar signal at each radiator of the antenna with a delay has an effect similar to that of phase shifting, and serves to establish a beam pointing direction. In typical true time delay beam steering, however, the conventional phase shifter discussed above is replaced with a true time delay device, which provides phase, by a time delay (which provides beam steering independent of frequency). The true time delay device may incorporate a number of switchable delay lines. An electrical or fiber optical cable of the appropriate length can be used to obtain delays and is typically switched into the transmit and receive signal path to generate the required time delay between signals corresponding to each of the antenna radiating elements.

Figure 5:
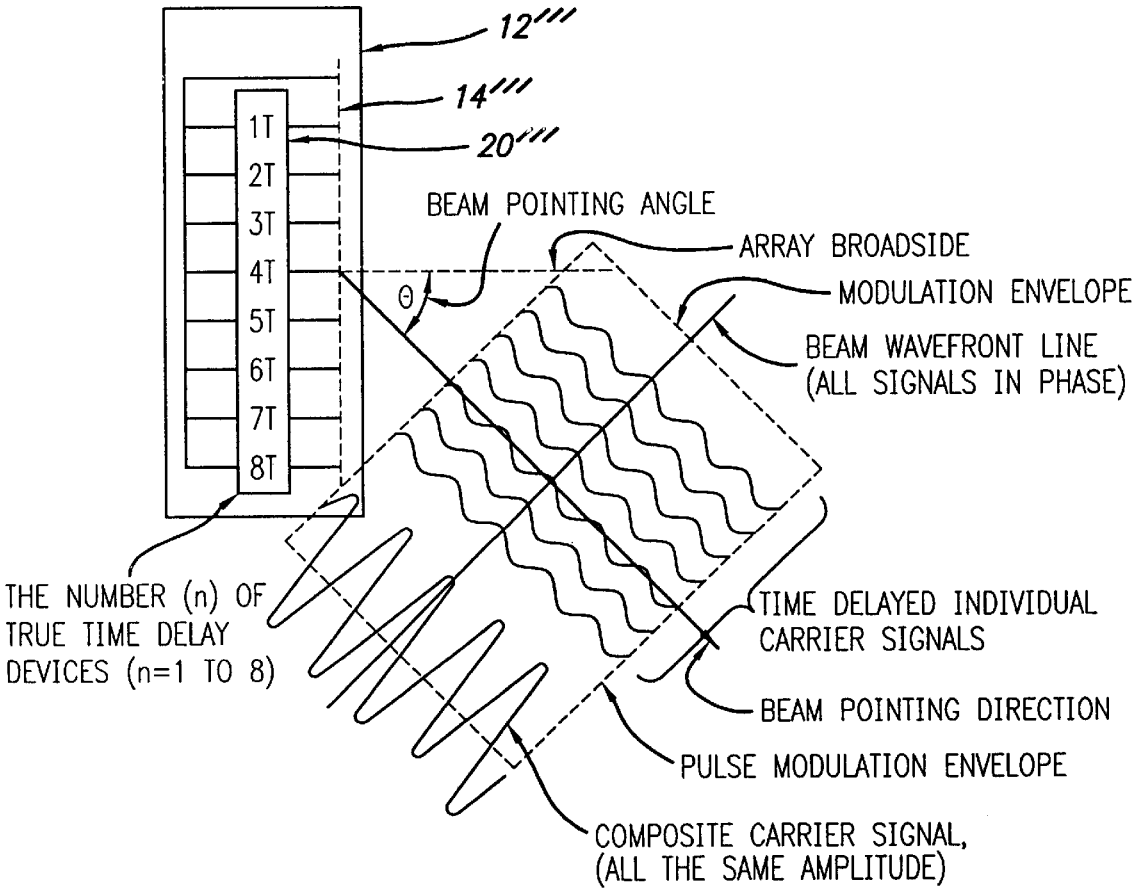
FIG. 5 is a diagram illustrating operation of a phased array antenna utilizing conventional true time delay devices.

FIG. 5 is a diagram illustrating operation of a phased array antenna utilizing conventional true time delay devices. FIG. 5 shows the effect of using a true time delay device to provide proper signal phase and modulation envelope time delay. The antenna 12''' in FIG. 5 system includes a number of true time delay devices 20''' which send and receive signals through corresponding antenna elements 14'''. The true time delay devices provide appropriate envelope time delay and frequency phase to establish a beam pointing direction at a desired beam-pointing angle. Beam pointing direction is perpendicular to the RF wavefront defined by the beam wavefront line. Since the proper time delay has been applied to the individual carrier signals from or to each of the antenna elements, each of the signals line up in time with the same phase within the modulation envelope, i.e., or the pulse envelope has been delayed in time. The time duration of the modulation envelope is therefore the same as the time duration of the pulse applied to each carrier signal. The signals combine to form a composite carrier signal, which has a constant amplitude within the pulse envelope. The composite carrier signal energy is concentrated within the modulation envelope because the time delay has caused all signals to line up in phase within the entire pulse envelope. The amount of time delay is determined independent of frequency to thus avoid the signal spreading problems associated with conventional phase shifters. Since the signals are delay in time the phase is taken care of automatically.

In a true time delay beam steered phase array such as that shown in FIG. 5, the signal transmitted or received by each of the n antenna elements is delayed by a time (n−1)T in order for the signals to line up in-phase and in time for a particular beam pointing direction. This will result in the transmitted or received signals forming an in-phase wavefront to form a beam that is not spread out or skewed and is in the desired beam pointing direction. The time delay T is determined for each of the true time delay devices in accordance with the following equation for calculation of true time delay.

$$T_n = \frac{(m-n)d\sin\theta}{v} \qquad [2]$$

In the above equation, m is the total number of antenna elements, $T_n$ is the time delay needed at element n to steer the array, n is the element number, d is the distance between adjacent elements, and v is the velocity of the RF in the medium of the delay device used. The time delay Tis therefore independent of frequency since frequency does not appear in the equation. A true time delay beam steered array is capable of providing these time delays for both transmit and receive signals.

It should be noted that an actual (or physical) delay will have a relative phase that depends on both the delay length and the carrier frequency that is used with that delay. If either the delay length or carrier frequency is changed, the relative phase is changed. Thus, in steering with actual delays, setting the delay to steer the array will automatically cause the correct relative phase wavefront to be generated to correctly steer the array in the desired beam direction. For each different carrier frequency used, the relative phase for the wavefront will be different but will be "automatically" correct for steering the array. Hence, TTD beam steering is independent of carrier frequency and the correct wavefront phase will be generated by only selecting the correct delay for steering the array. The delay steering works for an instantaneous frequency or a time varying frequency wavefront. As discussed more fully below, with the virtual time delay (VTD) provided by a system implemented in accordance with the present teachings, this correct phase at each instant of time is established by selecting the correct offset frequency for a time varying frequency waveform. Thus at any instant of time the phase along the beam wavefront will be correct. This phase and frequency are related, frequency being the rate of change of phase, and a device that generates a time varying phase can produce the same effect as a frequency. This changing phase technique, as opposed to a frequency based technique in this disclosure, is described in U.S. Pat. No. 4,263,600, entitled WIDE-BAND PHASE SCANNED ANTENNA, filed Apr. 21, 1981, by Williams, et al., the teachings of which are incorporated herein by reference. It should be noted that this VTD technique works independent at range or transmit but only over a region (delta range) around a selected range for receive. This difference will be discussed later.

It should also be noted that a phase array antenna is steered only in phase, not time. The time delay causes the envelope of a waveform from each radiator to line up at the same time to eliminate beam spread. Thus, to steer an array, the phase of each radiating element needs to be set such that the RF signal arrives at each antenna element (radiator) with a relative phase needed to steer the antenna array to the desired antenna pointing direction. Depending on the pulse frequency bandwidth, the antenna size and the pointing angle off broadside, having correct relative phase is not enough to steer the array.

The pulses from each radiator must also arrive at the same time or else the beam will spread or skew as depicted in FIG.

4. This can be most easily seen by considering, as an example, a pulse in the time domain which is a narrow pulse (i.e., 1 nanosecond wide with the corresponding instantaneous frequency bandwidth of 1 GHz) radiated from a long antenna (i.e., ten feet long and with a beam pointing angle of 30 degrees). The pulses from each radiator element will not arrive at the signal wavefront line at the same time, see FIG. 4. When the pulse width is long compared to the antenna length (say a 10 microsecond pulse) the error in actual time of arrival will be negligible and this is the case for most radars using phased steered arrays. Since time and frequency domains are related, one is proportional to the inverse of the other, the 10 microsecond pulse has bandwidth of 100 kilohertz. Thus viewed from the frequency domain, a small bandwidth signal will have negligible error.

As mentioned above, for those arrays where phase steering alone can not be used, then steering with true time delay is needed. This can be accomplished using a TTD at each radiator or a combination of TTD at the subarray level (where a subarray is the combining of the steering of several radiating elements) and phase only steering at the element. The true time delay can be either physical or virtual (for a ramp waveform) or some combination of both.

For applications requiring a long ramp pulse, the wide frequency of the ramp signal makes TTD steering needed at either the element or subarray level or both. As mentioned above, however, the cost and weight associated with TTD, limits the desirability of this solution and the applicability thereof.

The present invention provides a system and a technique for generation of a virtual time delay for array antenna beam steering without sending the waveform through an actual (physical) time delay. Here 'virtual' means providing a very close approximation to the beam steering capability provided by using true time delay for transmitting and a range limited very close approximation for reception. The inventive technique adjusts the frequency and thus the phase of an RF waveform that is spread out in frequency and time such that each frequency arrives at the radiating elements of a phased array antenna with the phase that will steer the antenna beam in the desired direction. The relative signal phase at each radiating element is made to be independent of the signal carrier frequency and thus the antenna beam pointing is made independent of RF carrier frequency.

The inventive virtual technique provides a very close approximation to an actual true time delay (TTD) when used for ramp type pulse waveforms that have relatively long pulse widths compared to the time delay across the antenna face (i.e., equivalent length of the array in time, where one foot of array length is equivalent to one nanosecond of delay time). There will be a small error in the actual time delay of the arrival of the waveform envelope from or at each of the radiating elements because the signals are not physically delayed in time. This small error will have a negligible effect on radar system performance as the virtual delay is a very close approximation to an actual delay time beam steering and the radar processing can remove the small pulse envelope error. The ramp type pulses (ramp meaning that the carrier frequency of the pulse varies as a function of frequency over time, or termed a time varying frequency, usually in a linear manner) have a carrier frequency rate of change during a pulse. These type of pulses are used as a long pulse RF waveform to obtain larger average transmit power while achieving high radar range resolution using a pulse compression signal processing technique.

The technique to obtain the virtual true time delay (VTD) for the ramp pulse waveform is to obtain an offset frequency by mixing a low frequency signal with the ramped RF carrier frequency, where the offset frequency is different for each of the signals going to each antenna radiator. The offset frequency is chosen to provide the desired virtual delay time for each radiator element. This delay time is selected to provide the equivalent delay time needed to steer the phased array antenna to the desired antenna beam-pointing angle. The delay time is only a function of a frequency difference (delta frequency) and the pulse ramp rate, and the resulting antenna beam steering is thus carrier frequency independent; i.e., the beam pointing is frequency independent. The VTD technique on transmit is independent of the range to a "target" (range to area of interest) but for receive the technique is limited to a delta range centered at the target.

The difference between transmit and receive use of VTD is that for receive, the VTD technique described in this disclosure works effectively for a limited range (delta range) around the "target" range that is processed. For transmit the start of the waveform ramp is established when the ramp is initiated. On receive the return signal ramps come back from all the ranges which mean they all effectively start at different ranges. Thus in receive the range to the "target" of interest needs to be selected so the VTD can be applied relative to that range. The VTD will be correct for the signal return at the radar received "target" signal range and degrades slowly at ranges different than the "target" range. The processing of received ramp waveforms is known in the art and the degradation can be calculated. Thus the range around the target where the return signal can be processed to obtain useable data can be established. Thus the description in this disclosure can be used for transmit without limitation and receive with the known limitation of degradation for ranges away from the "target" range selected. Any VTD technique for a ramp type waveform will have the same limitations, on receive, and the use of physical delays for TTD will not have a limitation on receive.

The present invention takes advantage of the fact that the wide bandwidth of the ramp is not instantaneous, as in a narrow pulse or phased coded equivalent narrow pulse, but is generated over some relatively long period of time. In accordance with the present teachings, the ramp frequencies are effectively delayed by an offset mixing process. This offset mixing produces a time delay that will cause the ramp signal to arrive continuously at the in-phase wavefront (pointing) line of the array at the correct frequency and phase and thus at the correct time for each frequency of the ramp waveform. Since the pulse is long compared to the array length, only a negligible time/phase error occurs, similar to that of a phased array with phase-only steering used over a limited carrier frequency bandwidth.

In addition, to minimize the small error in using the inventive VTD approach, the carrier frequency value used to calculate the value of the offset frequency for array steering should be the ramp center frequency. However, the invention is not limited to the shape of the pulses used as long as the waveform is a time varying frequency one rather than a pulse with an instantaneous frequency. That is, other pulse shapes may be used without departing from the scope of the present teachings. Also, since the long ramp covers a wide frequency band, it is processed (pulse compressed) by techniques known in the art for a wide bandwidth ramp signal waveform to obtain a high (meaning narrow) radar range resolution.

In accordance with the present teachings, beam steering for large arrays is effected by creating a virtual time delay for the signals transmitted and for signals received from around the target range such that the signals are effectively delayed in the same way that would occur with a physical delay. This virtual time delay in this disclosure is created by mixing a different offset frequency proportional to delay of the excitation (ramp) signal applied to each radiating element of the antenna.

Figure 6:
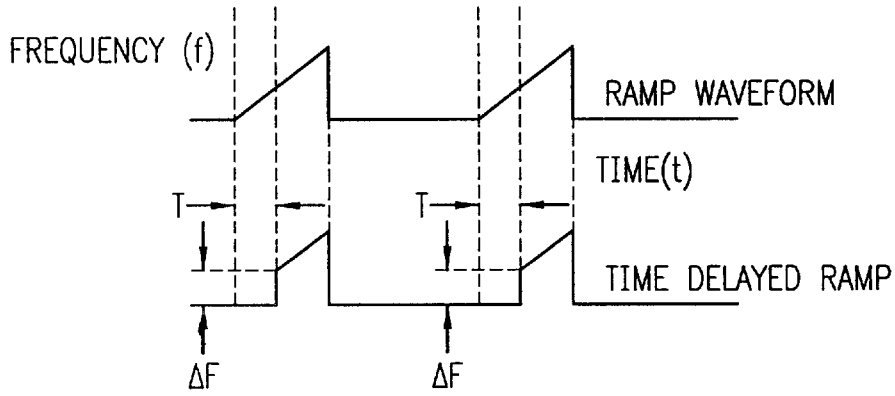
FIG. 6 is a diagram showing virtual time delay for a ramp waveform provided by an incremental frequency offset in accordance with the present teachings.

FIG. 6 is a diagram showing virtual time delay for a ramp waveform provided by an incremental frequency offset in accordance with the present teachings. The virtual time delay is obtained since the ramp frequencies are effectively delayed (by mixing with the offset frequency) such that the frequency of the ramp that arrives at each antenna radiator will be delayed as if the ramp had gone through an actual delay needed to beam steer the array.

Figure 7:
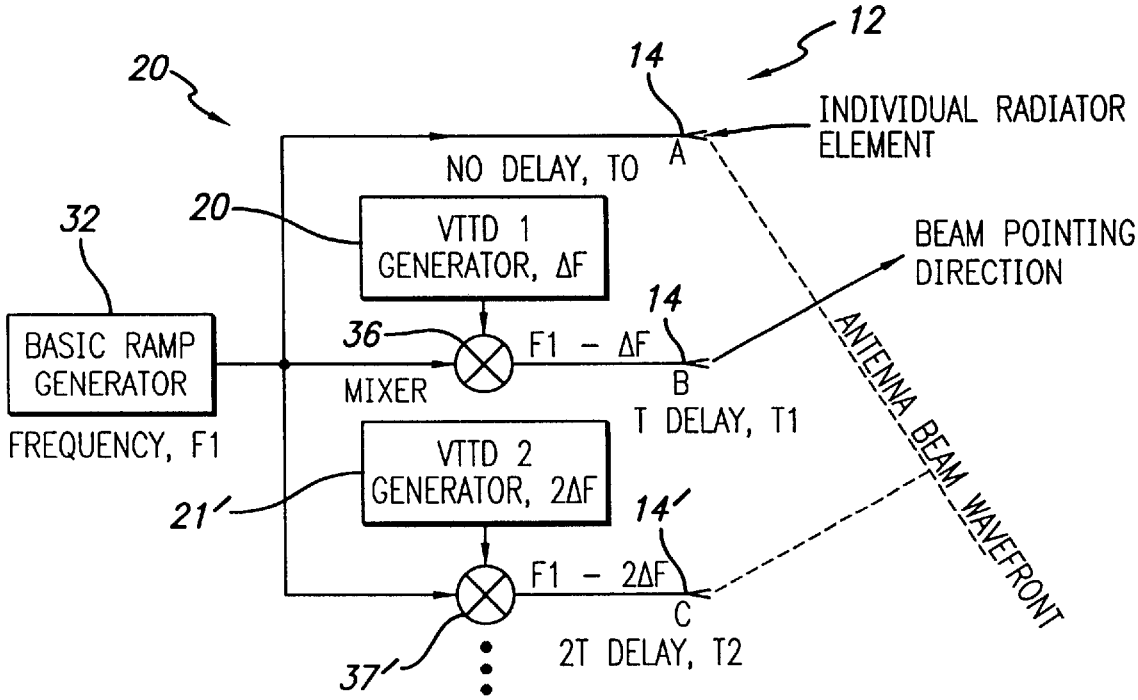
FIG. 7 is a simplified block diagram of a virtual time delay circuit implemented in accordance with the present teachings.

FIG. 7 is a simplified block diagram of a virtual time delay circuit implemented in accordance with the present teachings. In FIG. 7, a basic carrier ramp generator RF signal output is split and sent with the same (equal) actual delay to the radiating elements in a phased array radar with a delta (or relative) virtual delay generated by offset mixing the ramp signal going to each element. The offset frequency is mixed with the basic ramp carrier waveform prior to going to each radiator. The VTD 1, 2, etc. generators produce effective time delays, T0, T1, T2, etc., (time delays of 0, T and 2T) obtained by mixing offset frequencies of 0, (reference, no mixing), ΔF and 2ΔF, etc., to obtain frequencies of zero, F1−ΔF and F1−2ΔF prior to each radiator A, B, C, etc., respectively, to obtain the delta delay phases that will steer the output of the array. The ΔF is chosen to give the desired equivalent delay for beam steering the array in a given direction. The time delay T required to produce the needed varying phase, is calculated using the time delay equation [3]:

$$T = \frac{(\Delta F)(t)}{f} \qquad [3]$$

That is, the time delay (T) is equal to the mixing offset frequency AF divided by the ramp rate (f/t).

Thus, for each radiator A, B, C, etc., the ramp will arrive at the radiators with a frequency and phase such that each radiated pulse frequency arrives at the antenna beam wavefront, shown in FIG. 7, with the same frequency and relative phase. Beam pointing is determined by all signals being in phase and at the same frequency at the wavefront "line" shown in FIG. 7, where the beam pointing direction is perpendicular to the wavefront "line". The virtual time delay will have been generated to provide the needed delta varying relative phase time for the signal going to each radiator to obtain an equivalent TTD antenna beam steering. A different carrier frequency will not effect the needed ΔF. Only the ramp rate and antenna pointing direction will change the needed relative time delayed frequency for each radiator input signal. This beam pointing, that is independent of carrier frequency, is an identifying characteristic of TTD beam steering.

It is the relationship of frequency to phase that allows the mixing of a frequency with the ramp carrier frequency to produce the time varying relative phase to steer the array. Frequency is the rate of change of phase, so a mixing frequency can thus be used to produce a signal with a relative phase that will continually steer the array as the ramp frequency varies with time. All of these comments have been made relative to an individual radiator, but the same comments hold true for subarray beam steering, where the subarray is a group of radiator elements. Thus, the time varying phase shifter as described in the above-referenced Williams patent (U.S. Pat. No. 4,263,600) can also be used to steer an array. The use of frequency in this disclosure is another way to implement the correct phase versus frequency for a ramp waveform.

Figure 8:
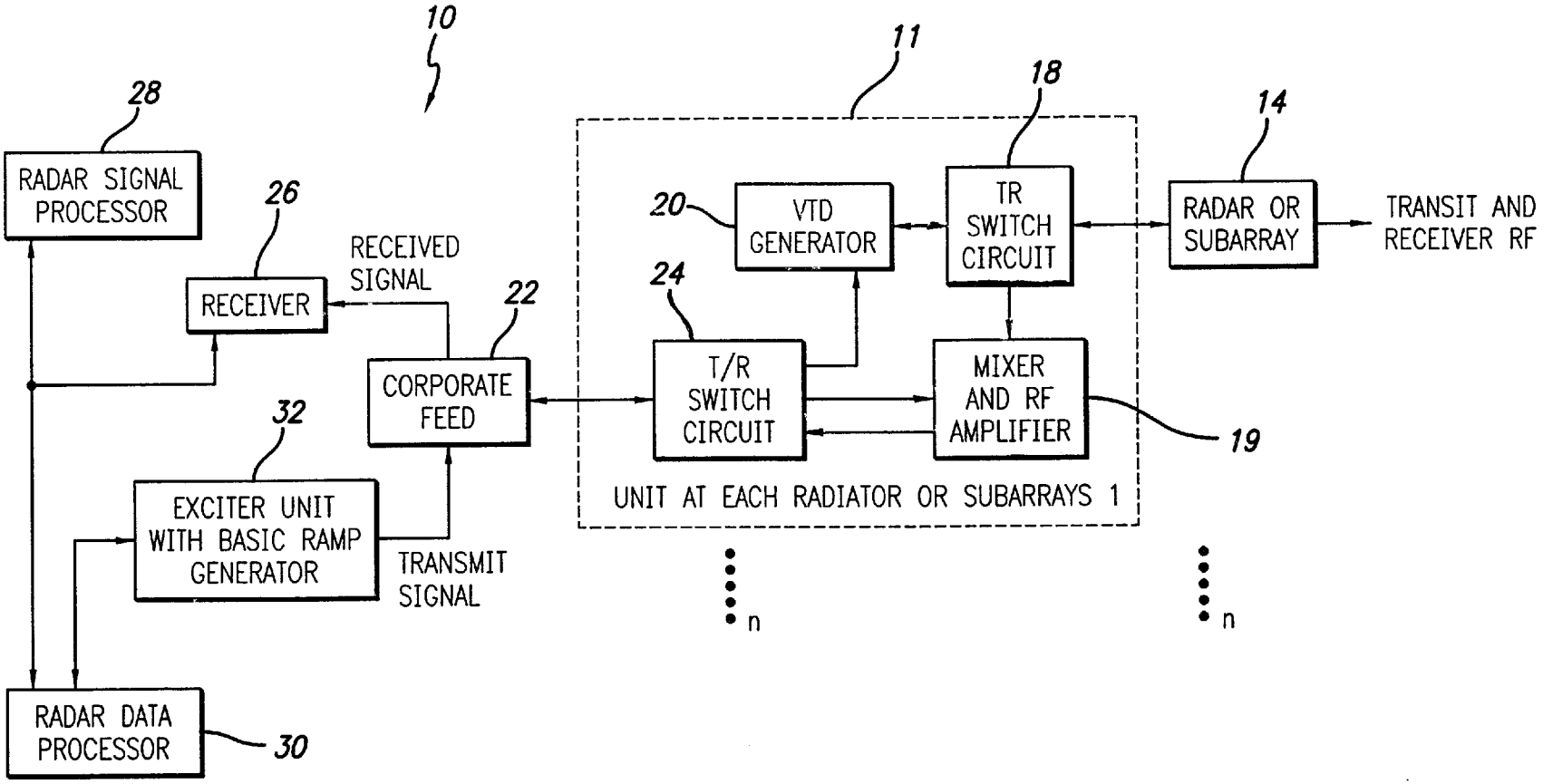
FIG. 8 is a block diagram of an illustrative implementation of a radar system incorporating the teachings of the present invention.

Not shown in FIG. 7 are filters needed between the mixers and the radiating elements. However, the filters are shown in the more detailed diagram of FIG. 9 below. FIG. 8 is a block diagram of an illustrative implementation of a radar system incorporating the teachings of the present invention. The system 10 of FIG. 8 is similar to the conventional system 10' of FIG. 1 with the exception that each of the antenna radiating elements or subarrays is fed by one of m circuits 11 consisting of a VTD generator 20 implemented in accordance with the present teachings in place of a physical delay element or a phase delay element. Each VTD generator 20 delays the ramp generated provided by the exciter unit 32 in the manner illustrated in FIGS. 6 and 7 above. In the illustrative implementation of FIG. 8, the T/R switches 24 are included in the circuit 11.

Figure 9:
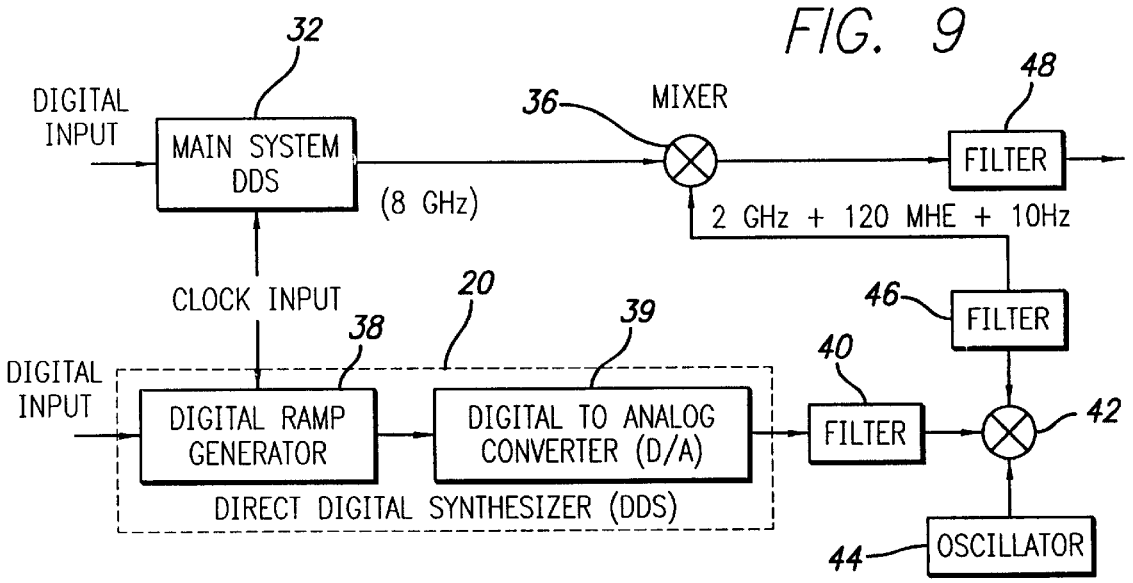
FIG. 9 is a block diagram showing the VTD generator of the present invention in more detail and the components with which it interfaces.

FIG. 9 is a block diagram showing the VTD generator of the present invention in more detail and the components with which it interfaces for signal to be transmitted. In the following, specific details of circuits and some typical frequencies are given only as an illustrative example for the transmit path. As shown in FIG. 9, the signals from the main system direct digital synthesizer (DDS) 32 are supplied as a first input to a mixer 36. The second input to the mixer 36 is provided by the VTD generator 20. In the best mode, the VTD generator 20 is implemented as direct digital synthesizer and includes ramp generator 38 and a digital-to-analog converter 39. The basic ramp frequency and each of the offset frequencies could be generated using different techniques. The advantage of a DDS circuit is that it can be controlled digitally to generate a waveform that can be a ramp or single frequency in the precise and accurate manner needed for true time delay radar waveform generation. This frequency control allows generation of offset frequencies that can precisely and accurately produce very small and/or large virtual time delay differences needed to TTD beam steer an array.

The signal generated by the DDS is typically at a lower frequency than that used as the radar radiated (transmitted) carrier frequency, and the output signal that is generated is typically mixed up (upconverted) or multiplied up to get a higher frequency prior to going to each element to get the frequency up to the desired radar transmit frequency. The mixing signal used needs to start at the same relative phase for each element and must arrive with the same delay at each mixer or multiplier circuit for each element.

The D/A converter 39 outputs a digitally controlled frequency. In the illustrative embodiment, the frequency of the signal output by the D/A 39 is 120 megahertz (MHz) plus a 10 Hz offset frequency (ΔF). A filter 40 is provided to remove spurious signals around the DDS frequency, e.g., 120 MHz in the example. In the exemplary implementation, the filter 40 is centered at 120 MHz and has a 4 MHz bandwidth. A submixer 42 mixes the output of the filter 40 with a signal supplied by an oscillator 44. In the illustrative embodiment, the signal is a 2 gigahertz signal. The output of the submixer 42 is processed by a filter 46 centered at 2 GHz+120 MHz with a 20 MHz bandwidth in the example. Hence, the filter 46 supplies a signal to the mixer 36, which is the output of the VTD 20. That is, the VTD 20 supplies to the mixer 36 a signal at 2 GHz+120 MHz+10 Hz where the 10 Hz component represents ΔF. This signal is mixed by the mixer 36 with the signal supplied by the basic ramp generator 32 and filtered by a filter 48, which, as mentioned above, is not shown in the simplified diagram of FIG. 7. The filter 48, in the illustrative embodiment, is centered at 10 GHz+120 MHz and has a 1 GHz bandwidth. As a result, the filter 48 outputs at signal at 10 GHz+120 MHz+10 Hz where the 10 Hz component represents ΔF.

In each subsequent VTD, the DDS 38 thereof outputs a signal at 120 MHz+mΔF, where m=1, 2, 3, 4, . . . (n−1) and n is the total number of array elements. In addition to steering the full array at each element, this technique can also be used for steering a subarray (i.e., combination of antenna elements steered as a group) of a large antenna array where VTD and other forms of beam steering can be used in combination for each individual radiating element or subarray. In the above the (n−1) is used since all values of m are relative to some frequency Δf of the basic reference radiator or the first radiator element or subarray of the antenna. Also, the mixers shown could be single sideband mixers, which will perform mixing, and some filtering of the undesired frequencies that the filters are used to remove.

For large arrays, the inventive VTD method of the present invention enables very long time delays in the order of many tens of nanoseconds to many hundreds of microseconds that can be needed to steer large arrays with virtual time delays that have relative time precision and accuracy in the order of a few picoseconds.

The same techniques used for obtaining the transmit VTD can be used in combination on the received radar signal with the delta range limitation cited earlier to obtain a VTD received signal provided a ramp frequency waveform was transmitted. The use for receive requires that a "receive" mixer be used at each radiator element or subarray. This receive mode use is most easily accomplished by using the same signals that were used for the radar transmitting signal waveform as the local oscillator (LO) signals at the mixer at each element or subarray for mixing the radar received signal. The "receive" mixer RF amplifier and switches are shown in FIG. 8 as 19, 18 and 24, respectively. In the simplest implementation, the mixing should be directly to baseband in order to obtain the correct signal equivalent to using an actual delay. If the signal is mixed to an intermediate frequency (IF), then the mixing delta frequency used to generate the local oscillator frequency for each mixer at each radiating element needs to be selected to get the correct time varying phase for the beam pointing direction and the sign of the phase of the mixed signal needs to be correct. The sign comes in because the mixed output can be either the sum or difference of the mixed signal frequency which will generate either a plus for the sum frequency or a minus for the difference frequency phase; the correct frequency and sign are obtained by filtering the mixed signal. This phase sign needs to also be considered for any mixing of the transmit signal.

In addition, when mixing the received signal the mixing LO signal at each mixer and the signal processing used for the composite (signals from all radiators or subarrays) received signal needs to be taken into account. Thus, the received LO can either be a ramp frequency with the offset frequency or a CW LO frequency with the offset frequency. The use of the ramp LO means that the mixed receive signals will be at a sequence of IF frequencies depending on range and can be processed using the techniques typically used for these type signals for radar pulse compression. By using this LO signal that is an offset (for each mixer) ramp, an analog to digital converter (A/D) can sample the composite signal at a lower frequency because the signal has been de-ramped. This limits the return signal in range coverage. When the mixed LO signal is not a ramp but a CW LO with the correct offset frequency for each radiator, then the signal processing used needs to take that into account. In this case, the A/D needs to sample the composite analog signal at a sampling rate that is equal to or greater than the Nyquist rate (i.e., so as not to have aliasing of the signal).

There are several other things to be considered for steering the beam correctly using the virtual time delay technique. It is important to note that the VTD technique just sets the relative phase as a function of time to steer the array, but the basic reference phase to steer the array still needs to be set. This can be accomplished using either a phase shifter at each radiator or setting the initial starting phase at each DDS used to establish the mixing frequency at each radiator. For subarrays, then the phase can be set with a phase shifter in each T/R module. Another is that all ramps need to start at the same (reference) phase and the offset mixing frequencies must start at the same phase. It should also be noted that when a DDS is used to generate the offset frequencies, each DDS needs to be reset for each radar pulsed ramp to assure the phases do all line up correctly. VTD also offers an effective way to adjust phase or time delay errors in calibration of an array. Also, if the virtual TTD signal is up or down converted in frequency, the positive phase value needs to be obtained (the negative phase will steer the array incorrectly). All of the above conditions can be met as described or the phases adjusted so the conditions are met. Since the antenna is steered in relative phase, the end result at the radiator needs to be a signal that will arrive at the correct relative phase at the same frequency and time at the wavefront line of the array. The process used for a virtual time delayed signal will assure this correct arrival condition provided the above requirements are met. Also, any phase or time errors in the signal path to each radiator or subarray can be calibrated out using adjustments in the virtual time delays set for each radiator or subarray. This is a convenient way to calibrate the array after determining what are the misalignment errors.

As described earlier the receive signal is different in that these signals are received from any given range all at the same time but the processing requires that the range that is of interest (where a target might be) needs to be selected so the mixing local oscillator ramp signal (used for de-ramping the received signal for signal processing) can be started at the correct time of the center of the range of interest. As the range return that is near-by the selected range comes back, ranges that are greater or less than the selected range will not have the exact correct delay for true time delay steering. This error occurs for ranges that are away from the center (selected) range (or delta range) and how much range coverage around the center range depends on the particular ramp signal parameters. Thus, on receiver, the use of this VTD technique is limited in range coverage (ground delta range width) around a pre-selected "target" or range center. The range coverage that can be obtained is determined by the amount of degradation in the processed signal that has acceptable errors where the error increases for the delta range away from the center range selected. The radar waveform parameters that determine the error vs. delta range from the center range are known in the art of processing ramp signal returns.

On receive, the same ramp generation process that is used for the transmit signal can be used as the mixing local oscillator signal on receive. The start of the ramp used as the local oscillator signal needs to be selected based on the range that is desired to be searched by the radar.

For steering on receive, digital beam forming instead of VTD can also be used to allow signal processing of wide bandwidth signals without physical time delays being used in the radar system. This is done by signal processing using an analog to digital converter (ADC) that has a fast enough sampling rate to sample the received signal. This requires a fast ADC at each element or subarray and complex signal processing compared to using a VTD offset ramp frequency technique.

Thus, in summary, a VTD can be generated for steering arrays using frequency ramp type waveforms (that is, signals with a time varying frequency) that need TTD beam steering by using an offset frequency mixed with a ramp waveform. This VTD is useful when there is a large array where long delay times are needed to steer the array. VTD offers an accurate and precise way of setting the delay that is difficult to achieve with convention delay techniques (i.e., electrical or fiber optic cables), especially for long delays and also a convenient way to adjust array for any phase or time errors. The technique described in this disclosure is one of several techniques for implementing VTD. The specific technique used will depend on which one is the best for any given application.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. An antenna system comprising:

a phased array antenna having a plurality of radiating elements and beam steering means for providing a respective virtual time delay with respect to an excitation signal applied to each radiating element, the beam steering means including means for applying a predetermined frequency offset to each radiating element.

2. The invention of claim 1 wherein the beam steering means includes a plurality of signal sources, for providing a predetermined frequency offset signal for each radiating element.

3. The invention of claim 2 wherein the beam steering means further includes a plurality of mixers, each mixer adapted to receive an excitation signal as a first input and the output from a respective one of the sources as a second input, the output of each mixer being coupled to a respective one of the radiating elements.

4. A method for steering a beam with an array antenna having a plurality of radiating elements including the steps of:

generating a set of signals having predetermined offset frequencies and applying a respective one of each of the signals to a respective subset of the elements of the antenna.

5. An antenna system comprising:

a phased array antenna having a plurality of radiating elements;

a phase shifter coupled to each of said radiating elements and beam steering means for providing a respective virtual time delay with respect to an excitation signal applied to each radiating element, the beam steering means including means for applying a predetermined frequency offset to each radiating element via a respective one of said phase shifters.

* * * * *